US006064044A

United States Patent [19]

Jerome

[11] Patent Number: 6,064,044

[45] Date of Patent: May 16, 2000

[54] AUTOMATED BOTTLE TEMPERATURE CONTROL SYSTEM

[76] Inventor: Leno Jerome, P.O. Box 922, Bellaire, Tex. 77402

[21] Appl. No.: 09/197,830

[22] Filed: Nov. 23, 1998

[51] Int. Cl.[7] ..... H05B 1/02

[52] U.S. Cl. ..... 219/501; 497/506; 497/494; 392/456; 392/451

[58] Field of Search ..... 219/501, 497, 219/494, 483, 506; 392/441, 445, 442, 449, 454, 456

[56] References Cited

U.S. PATENT DOCUMENTS

| | | | |
|---|---|---|---|
| 3,892,945 | 7/1975 | Lerner | 219/437 |
| 4,572,427 | 2/1986 | Selfridy et al. | 236/3 |
| 5,671,325 | 9/1997 | Robertson | 392/442 |

*Primary Examiner*—Mark Paschall

[57] ABSTRACT

An Automated Bottle Temperature Control System 10 is provided having a main DC power source 34, a water temperature sensing and control means 38, a water level compliance circuit 58, a bottle container rack 205. The main DC power source is provided to supply required DC voltages of different levels and polarities to the different electronics circuits. The water temperature sensing circuit is provided to sense the temperature of the water in reservoir, if the temperature of the water is below the preset level, the water temperature control circuit is activated, if the water temperature is equal to or greater than the water temperature, the water temperature control circuit is not activated. The water temperature control circuit is provided to control the water temperature, by energizing and deenenergizing the heating element. The energizing and deenenergizing of the heating element hinge upon the voltage level it receives from the sensing circuit. The water level compliance circuit is provided to alert the user that the water level is low. When the water level is low an LED illuminates a display that reads "ADD WATER," a tone is sounded, and the heating element is disconnected. The bottle container rack is used to transfer heat energy from the heated water in the reservoir to the to the liquids within the bottles.

4 Claims, 2 Drawing Sheets

AUTOMATED BOTTLE TEMPERATURE CONTROL SYSTEM

TECHNICAL FIELD

This invention relates to an Automated Bottle Temperature Control System to be used to facilitate the safe heating of baby formula in hospitals or other care providing institutions. In most institutions today, very imprecise methods are used to gauge the temperature of baby formulas within their feeding bottles. The most common method used today, is the heating of water on a stove, then the bottle with the formula is placed therein. This method may be adequate for one child, but is inadequate and sometimes dangerous for large Pediatrics setting where formulas must be prepared for a large number of infants simultaneously. This invention will greatly increase the efficiency and safety in the preparation of formulas in Pediatrics or similar setting.

BACKGROUND ART

There have been many attempts made to control the temperature of liquid within Babies Bottles, but with very little success. One such attempt was made by Kalyk in his U.S. Pat. No. 3,658,122. This invention fell short of providing automated temperature control for liquids in baby feeding bottles. Kalyk's invention involves nothing more than immersing a bottle with cold liquid into a container of warm water, and letting the bottle remain until thermal equilibrium is reached. Kalyk's method of warming liquid within bottles is not applicable for this application.

SUMMARY OF INVENTION

This invention relates to an Automated Bottle Temperature Control System used to automatically, precisely, and safely control the temperature of infant formulas within their feeding bottles. The bottles with the formulas are placed into the bottle size adapter, which is then placed onto the bottle container rack. Water is then poured into the reservoir via the opening provided, until the appropriate level is reached. After this level is reached, the cover is affixed, then power is applied. Upon the application of power, the electronics control circuitry starts controlling the temperature of the formulas within the bottles.

BEST MODE FOR CARRYING OUT THE INVENTION

Figure 1:
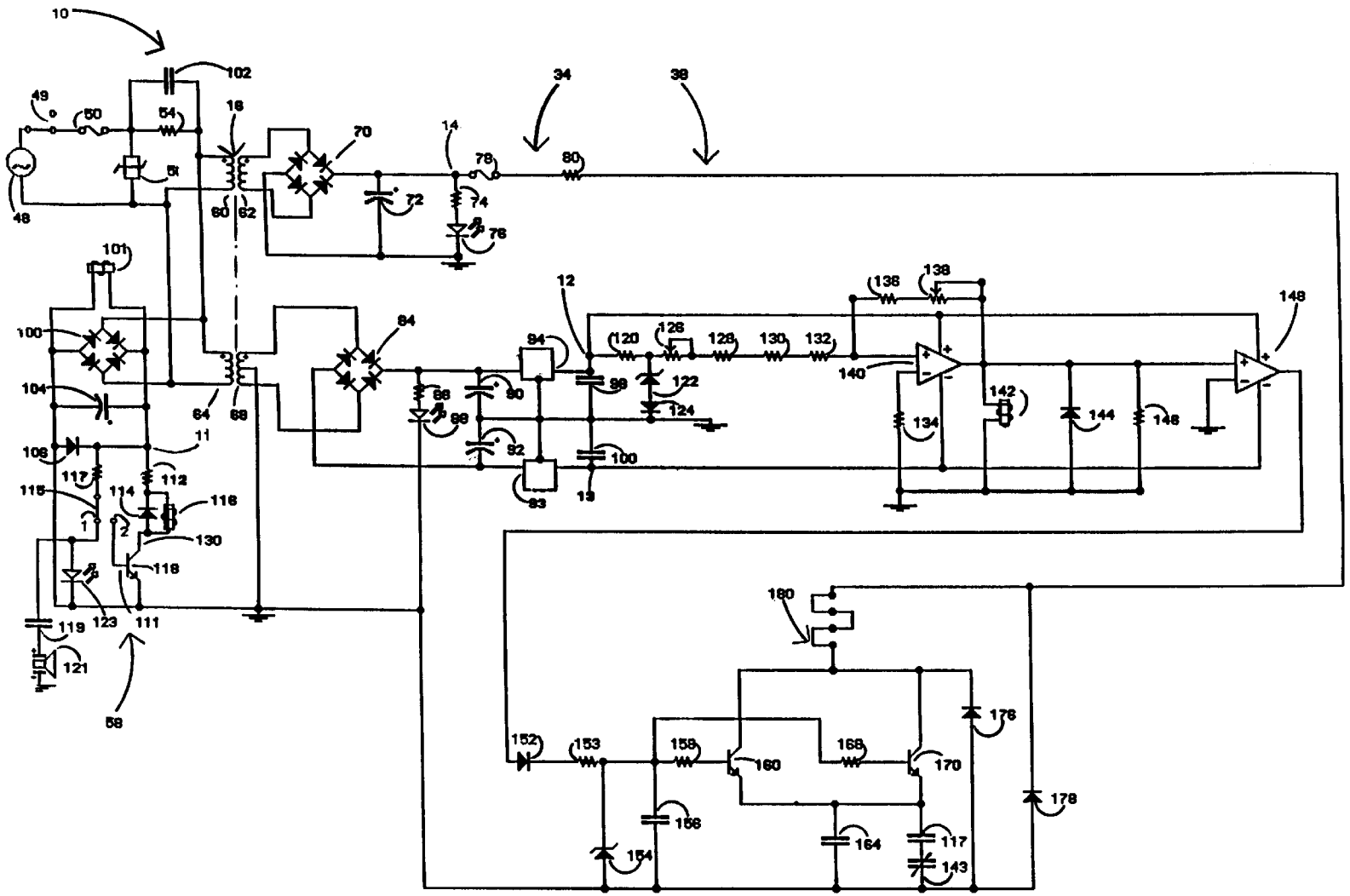
FIG. 1 is an electronics schematic diagram of the Automated Bottle Temperature Control System.

In FIG. 1 there is shown an electronic schematic diagram of the Automated Bottle Temperature Control System, generally designated by the numeral 10. The Automated Bottle Temperature Control System 10 includes a DC power source, generally designated by the numeral 34. DC power source 34 is comprised of two unregulated DC power supplies with output terminals generally designated by numerals 11 and 14, respectively; one positive regulated DC power supply with output terminal generally designated by numeral 12, and one negative regulated DC power supply with output terminal generally designated by numeral 13. Terminal 14 supplies power to the heating element generally designated by numeral 180, through the series connection of Fuse 78, and resistor 80. Terminal 11 provides power for the time delay relay generally designated by numeral 101, and the liquid level compliance circuit generally designated by numeral 58. Terminal 12 provides positive bias voltage for the Operational Amplifiers generally designated by numerals 140 and 148, respectively. Terminal 13 provides negative bias voltage for the Operational Amplifiers referenced above.

The DC power source 34 of the Automated Bottle Temperature Control System 10 uses a power transformer 16, having two primary and two secondary windings 62 and 68. The two primary windings are connected in parallel, and the two secondary windings are also connected in parallel. Diode bridge rectifier 100 is provided to convert alternating current (ac) power to direct (DC) power. Filter capacitor 104 is provided to filter out the ripple. Diode bridge rectifier 70 is provided to convert alternating current (ac) power to direct (DC) power. Filter capacitor 72 is provided to filter out the ripple; light emitting diode (LED) 76 is used as an indicator, while fuse 78 is provided for over current protection. Diode bridge rectifier 84 is provided to convert alternating current (ac) power to one positive and one negative direct (DC) power supply, respectively. Filter capacitor 90 is provided to filter out the ripple from the positive (DC) supply, while Filter capacitor filters the negative (DC) supply. Voltage regulator 94 regulates the positive DC supply, while Voltage regulator 96 regulates the negative DC supply. Time delay relay 101, it's normally open contact 102, and resistor 54 is provided to limit inrush current. Power switch 49 is provided to connect ac power to the system; Fuse 50 is provided for over current protection, and varistor 51 is provided for transient suppression.

The Temperature Sensing and Control Circuits of the Automated Bottle Temperature Control System 10, is generally designated by numeral 38. Capacitors 98 and 100 are provided for additional ripple suppression. Resistor 120, Zener diode 122, diode 124, and variable resistor 126, provides regulated DC voltage for the input of the temperature sensing circuit. The input of the Temperature sensing circuit consists of three Positive Temperature Coefficient (PTC) thermistors designated by numerals 128, 130, and 132. The feedback loop of the of the Temperature sensing circuit consists of variable resistor 138 and Negative Temperature Coefficient (NTC) thermistor 136. Operational Amplifier 140 is the processor for the temperature sensing circuit, and resistor 134 is provided for stabilization. Relay 142 and it's normally closed contact 143 is provided as a safety circuit. Diode 144 is used as a catch diode for relay 142. Operational Amplifier 148 is connected as a comparator, resistor 146 is provided as a voltage stabilization means at the positive input lead of 148. Diode 152 is used to couple the temperature sensing circuit of 38 to its temperature control circuit. Resistor 153 and zener diode 154 limits the voltage level applied to the input of the temperature control circuit. The temperature control circuit is comprised of capacitors 156 and 164, resistors 158 and 168, transistors 160 and 170, diodes 176 and 178, normally open contact 117 and normally closed contact 143. Heating element generally designated by the numeral 180 is used for heating the water. The water level compliance circuit of Automated Bottle Temperature Control System 10, is generally designated by the numeral 58; which consists of diodes 106 and 114, resistors 112 and 117, relay 116, transistor 118, LED 123, capacitor 119, speaker 121, and switch 115.

Figure 2:
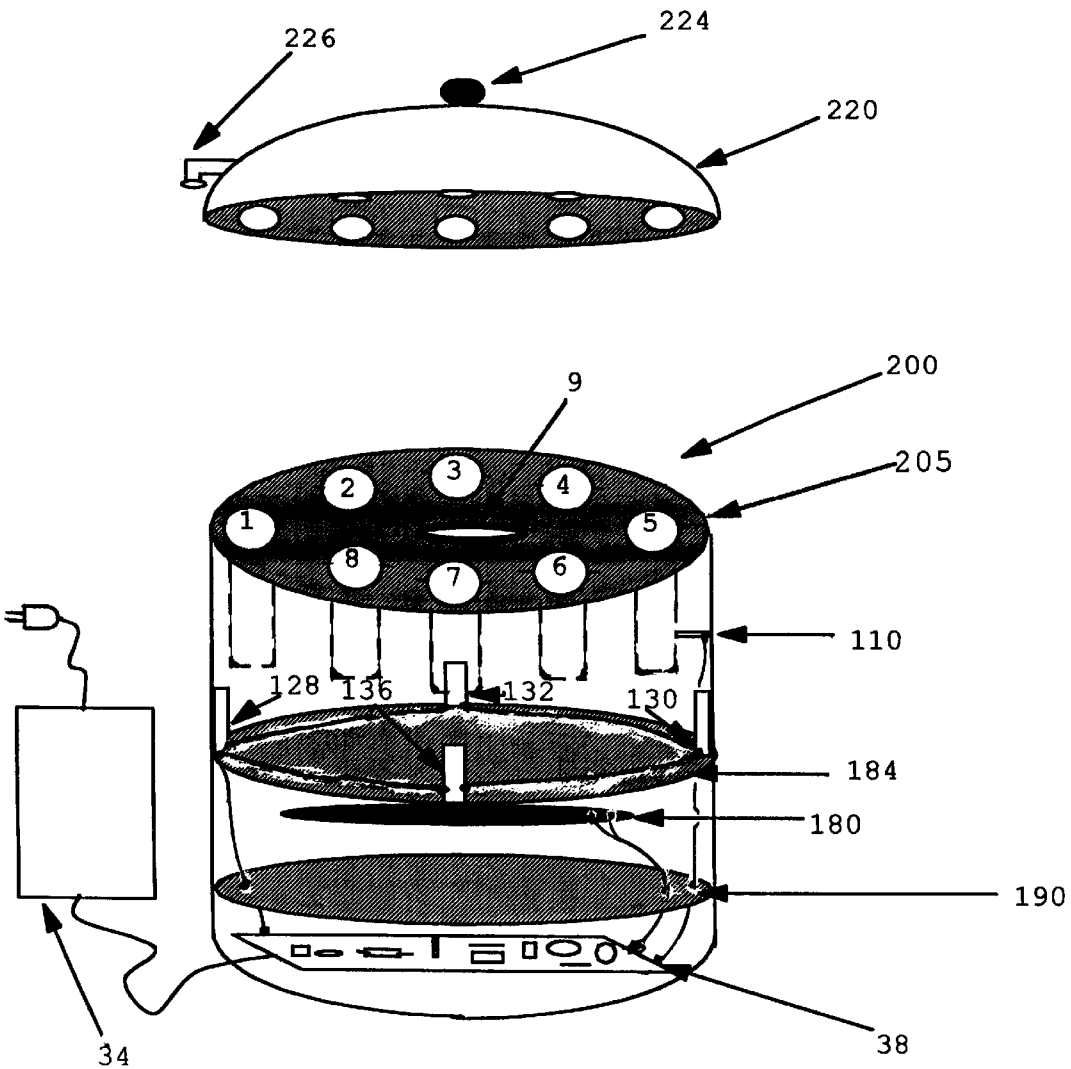
FIG. 2 is a sectional view of the system in accordance with the principles of this invention.

Referring to FIG. 2 there is shown a Sectional View of the Automated Bottle Temperature Controlling System 10 in accordance with this invention. Container 200 houses the temperature sensing and control circuits 38, water level compliance circuit 58, heat shield 190, heating element 180, temperature sensors 28, 130, 132, and 136; a bottle container rack generally designated by the numeral 205, with eight openings for bottle and adopters designated by numerals 1,2,3,4,5,6,7, and 8. The opening designated by the numeral 9 on 205 is provided to facilitate the addition of water to the reservoir, and 184 is the bottom of the reservoir. Also depicted in FIG. 2 is the cover of 200 generally designated by numeral 220, attached to the cover is a handle designated by numeral 224, and a relief valve designated the numeral 226. The DC power source 34 is also depicted in FIG. 2.

Figure 3:
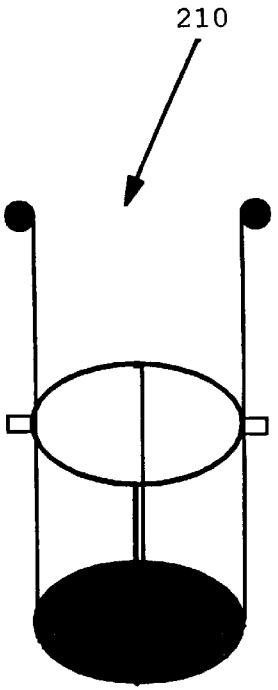
FIG. 3 is a pictorial diagram of one of the bottle holders.

Referring to FIG. 3 there is shown a pictorial diagram of an adopter for a bottle generally designated by the numeral 210.

To operate the Automated Bottle Temperature Controlling System 10; the bottle size adapters 210 are placed into the bottle container rack 205, which has openings designated by the numerals 1 through 8, then the bottles containing the liquids are placed into 210. 120 volts ac power 48 is applied to the system by placing switch 49 in the on position. With 49 in the on position, power is applied to the two primary windings of transformer 16, designated by numerals 60 and 64, and diode bridge rectifier 100, through resistor 54. Although time delay relay 101 is energized, there is about a two seconds delay before its normally open contact 102 becomes closed. This delay is necessary to reduce the inrush current. At this point if the water level in the reservoir is low, level switch 115 will remain in the 1-position, causing LED 123 to be eliminated, and a tone emitted from speaker 121. Water is poured into 200 via the opening designated by the numeral 9 until level switch 115 is switched to the 2-position. With the level switch 115 in the 2-position, power is applied to transistor 118 at its base terminal 111, causing it to turn on. This causes current to flow through resistor 112, relay 116, transistor 118; entering at its collector terminal 130, to ground. At this point 116 closes it's normally open contact 117, completing the emitter circuits of transistors 160 and 170. Since the primary windings 60 and 64 of transformer 16 is energized, power is transferred magnetically to its secondary windings 62 and 68. The energizing of 62 and 68 causes power to be applied to diode bridge rectifiers 70 and 84 simultaneously. Diode bridge rectifier 70 converts the ac power applied to it into pulsating DC power, then filter capacitor 72 converts it to a relatively pure DC power. This causes power to be applied to LED 76 via current limiting resistor 74, causing 76 to be illuminated. The output of this unregulated DC power supply is connected to Fuse 78 for over current protection, and resistor 80 is connected in series with 78 to provide current limiting means when transistors 160 and 170 conduct current via heating element 180. Because power is applied to diode bridge rectifiers 70 and 84 almost simultaneously, 84 converts the ac applied to it into pulsating DC power. This DC power causes current to flow through resistor 86 to LED 88, illuminating it. Bridge diode rectifier 84 provides one positive and one negative pulsating DC supply. The positive pulsating DC power is filtered by Filter capacitor 90, regulated by Voltage Regulator 94, and seen at node 12. The negative pulsating DC power is filtered by Filter capacitor 92, regulated by voltage regulator 93, and seen at node 13. If the temperature of the water that is poured into the reservoir is below the preset level, set by variable resistors 126 and 138, the following occurs: the Operational Amplifier 140 amplifies the voltage difference seen between its negative and positive terminals. This amplification is controlled by the formula:

Output Voltage=(Input Voltage) [(136+138)/(126+128+130+132)]+1. Resistors 128,130,132, and 136, are the sensors of the sensing circuit; while variable resistors 126 and 138 are used for presetting the sensitivity of the circuit. If the temperature of the water in the reservoir is below the preset level, the resistance of 128, 130, and 132 falls; while the resistance of 136 rises, this causes a relatively high output voltage to be seen at the output of 140. On the other hand, if the temperature of the water in the reservoir is equal to, or greater than the preset level, the resistance of 128, 130, and 132 rises; while the resistance of 136 falls, this causes the voltage at the output of 140 to approach zero volt. The output of 140, which is the output of the sensing circuit, is fed to the positive input terminal of Operational Amplifier 148 that is connected as a comparator. Operational Amplifier 148 amplifies the voltage seen across its input terminals and delivers a high voltage level to its output terminal that is used to turn on transistors 160 and 170, which in turn causes current to flow through heating element 180. Heating element 180 keeps heating the water in the reservoir, which transmits heat energy to the bottle container rack 205; which in turn provides the heat energy for heating the liquids within the bottles. The temperature of the water keeps rising until the preset temperature level is reached. At that point the output voltage approaches zero volt. With zero volt seen across the inputs of 148, its output voltage approaches zero, which turns off transistors 160 and 170. When transistors 160 and 170 are off, no current flows through 180 to keep it heated. When this point is reached, the bottles with the heated liquid is ready for dispensing. The heating cycle repeats itself when the temperature of the water in the reservoir drops below its preset level. Relay 142 is provided as a protection means in the event resistors 136 or 138 fails open. If resistor 136 or 138 fails open, the voltage seen at the output of Operational Amplifier 140 will be high enough to energize relay 142, causing it to open it's normally closed contact 117. With 117 open, transistors 160 and 170 turns off severing power to the heating element 180. Diode 144 is used as a catch diode for relay 142, while resistors 134 and 146 are used for stabilization purposes. Diode 152, capacitor 72 converts it to a relatively pure DC power. This causes power to be applied to LED 76 via current liming resistor 74, causing 76 to be illuminated. The output of this unregulated DC power supply is connected to Fuse 78 for over current protection, and resistor 80 is connected in series with 78 to provide current limiting means when transistors 160 and 170 conducts current via heating element 180. Because power is applied to diode bridge rectifiers 70 and 84 almost simultaneously, 84 converts the ac applied to it into pulsating DC power. This DC power causes current to flow through resistor 86 to LED 88, illuminating it. Bridge diode rectifier 84 provides one positive and one negative pulsating DC supply. The positive pulsating DC power is filtered by Filter capacitor 90, regulated by Voltage Regulator 94, and seen at node 12.

The negative pulsating DC power is filtered by Filter capacitor 92, regulated by voltage regulator 93, and seen at node 13. If the temperature of the water that is poured into the reservoir is below the preset level, set by variable resistors 126 and 138, the following occurs: the Operational Amplifier 140 amplifies the voltage difference seen between its negative and positive terminals. This amplification is controlled by the formula:

Output Voltage=Input Voltage (136+138)/(126+128+130+132). The output voltage is fed to the positive input terminal of Operational Amplifier 148 that is connected as a comparator. Operational Amplifier 148 amplifies the small voltage seen across its input terminals and delivers a high voltage level to its output terminal that is used to turn on transistors 160 and 170, which in turn causes current to flow through heating element 180. Heating element 180 keeps heating the water until the preset temperature level is reached, then the output voltage level approaches zero volt. With zero volt seen across the inputs of 148, this causes it to turn off which turns off transistors 160 and 170. When transistors 160 and 170 are off, no current flows through 180 to keep it heated. The heating cycle repeats itself when the temperature drops below its preset level. Relay 142 is provided as a protection means in the event resistors 136 or 138 fails open. If resistor 136 or 138 fails open, the voltage seen at the output of Operational Amplifier 140 will be high enough to energize relay 142, causing it to open it's normally closed contact. With 117 open, transistors 160 and 170 turns off severing power to the heating element 180. Diode 144 is used as a catch diode for relay 142, while resistors 134 and 146 are used for stabilization purposes. Diode 152, resistors 158, 168, and zener diode 154 are used to protect the base circuit of transistors 160 and 170. Capacitors 156, 164; diodes 176 and 178 are provided for transient purposes. When the water level drops below a certain level, the water level limit switch 115 opens causing LED 123 to illuminate and speaker 121 to sound. Capacitor 119 is provided for tone variation means.

What is claimed is:

1. An automated bottle temperature control system comprising;

an enclosure having an opening formed therein, a heating element contained within said enclosure, a bottle rack fitted inside the enclosure at a top of the enclosure, said rack having multiple compartments for holding bottles of liquid, means for filling the enclosure with a liquid to be heated for heating the contents of the bottles, liquid level sensing and control means for indicating a low level of liquid in the enclosure to an operator of the system and for disconnecting power supply to the heating element in response to a sensed low liquid level in the enclosure, temperature control means for maintaining the liquid in the enclosure at a predetermined temperature, said control means comprising; multiple temperature sensors for sensing the liquid temperature and providing a signal representative of the liquid temperature, a comparator for comparing said signal to a set point signal and switch means responsive to the comparator output signal for operating a switching means to regulate supply of direct current power supply to the heating element.

2. An automated bottle temperature control system according to claim 1 wherein said enclosure has a cover for providing sanitary protection for the bottles.

3. An automated bottle temperature control system according to claim 1 further comprising a bottle size adapter means for the rack.

4. An automated bottle temperature control system according to claim 1 wherein the power supply to the heating element comprises a power transformer with two primary and two secondary windings for use in either 120 voltage or 240 voltage systems.

* * * * *